US006538680B2

(12) United States Patent
Sato

(10) Patent No.: US 6,538,680 B2
(45) Date of Patent: Mar. 25, 2003

(54) THERMAL PRINTER

(75) Inventor: Yoshinori Sato, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 10/061,122

(22) Filed: Jan. 31, 2002

(65) Prior Publication Data

US 2002/0135659 A1 Sep. 26, 2002

(30) Foreign Application Priority Data

Mar. 26, 2001 (JP) ..... 2001-088047

(51) Int. Cl.[7] ..... B41J 25/304
(52) U.S. Cl. ..... 347/197
(58) Field of Search ..... 347/197, 220; 400/120.16

(56) References Cited

U.S. PATENT DOCUMENTS

| | | | | |
|---|---|---|---|---|
| 5,146,238 A | | 9/1992 | Numabe et al. | 346/76 PH |
| 5,612,727 A | | 3/1997 | Morimoto et al. | 347/198 |
| 5,903,298 A | * | 5/1999 | Takeuchi et al. | 347/197 |

FOREIGN PATENT DOCUMENTS

| | | | | |
|---|---|---|---|---|
| EP | 0700789 | | 3/1996 | |
| JP | 2969495 B2 | * | 11/1999 | B41J/25/304 |

OTHER PUBLICATIONS

Patent Abstracts of Japan, vol. 016, No. 538 (M–1335) Nov. 9, 1992, publication No. 04201373, publication date Jul. 22, 1992.

Patent Abstracts of Japan, vol. 018, No. 366 (M–1636), Jul. 11, 1994, publication No. 06099642, publication date Apr. 12, 1994.

Patent Abstracts of Japan, vol. 016, No. 585 (M–1347), Dec. 25, 1992, publication No. 04232087, publication date Aug. 20, 1992.

Patent Abstracts of Japan, vol. 014, No. 347 (M–1002) Jul. 26, 1990, publication No. 02120065, publication date May 8, 1990.

* cited by examiner

*Primary Examiner*—Huan Tran
(74) *Attorney, Agent, or Firm*—Adams & Wilks

(57) ABSTRACT

To provide a thermal printer which can prevent the lifting phenomenon of the platen roller without reducing the printing speed.

There is provided a thermal printer comprising: a frame (1) having a pair of side wall portions (2*a* and 2*b*) arranged to face each other at a predetermined interval in a paper width direction; a head support member (4) for holding a thermal head (3); a platen roller attaching/detaching mechanism (A) for detachably and rotatably bearing a platen roller (10) by the above-described pair of side wall portions; a pressing mechanism (B, coil springs S1 and S2) for bringing a surface of the above-described thermal head into contact with a circumferential surface of the above-described platen roller; and a gear transmission mechanism (G1) for transmitting a rotational driving force of a motor (M) to a driven gear (G2) fixed at one end of the above-described platen roller, wherein pressing force applied on a shaft end on the driven gear side of the above-described platen roller by the above-described pressing mechanism is made to be within a range of 1.3 to 3.0 times of pressing force applied on the other shaft end.

7 Claims, 6 Drawing Sheets

THERMAL PRINTER

BACKGROUND OF THE INVENTION

1. Field of the Invention

The present invention relates to a small-sized thermal printer mounted on a desk-top type electronic apparatus that is installed in a shop or on various portable information devices, and more particularly to a thermal printer having a structure in which, even if a platen roller is of a detachable type, there is no positional displacement between a thermal head and a platen roller during the printing operation.

2. Description of the Related Art

A conventional example of a general small-sized thermal printer provided with a line-type thermal head will now be described with reference to FIGS. 7 to 10.

The thermal printer P2 shown in FIG. 7 is provided with a platen roller 102 pivoted rotatably to a frame 101, a head support member 103 provided with a thermal head (not shown in FIG. 7) facing the platen roller 102 and a platen spring 104 for giving a biasing force for pressing this head support member 103 against the platen roller 102.

Also, the thermal printer P2 of FIG. 7 is provided with a head-up lever 105 or the like having a cam for moving the above-described head support member 103 apart from the platen roller 102 during the maintenance operations for the paper clog due to paper jam or for replacement of recording paper. The head-up mechanism composed of this head-up lever 105 is a mechanism provided for the purpose of making it possible to manually separate the platen roller 102 and the head support member (thermal head) 103 away from each other by a predetermined distance (for example, at an interval of several millimeters) in order to enable, for example, replacement operation of a thermal sensitive type recording paper or operations for removing paper clog due to paper jam that occurs almost unavoidably.

In the thermal printer P2 shown in FIG. 7, since the platen roller 102 is of a fixed type such that the roller cannot be detached, there is an advantage that the positional precision between the thermal head and the platen roller 102 is high.

Also, a driven gear (not shown in the drawing) to be engaged with a gear train provided with a motor M as a drive source is provided on one side (on the right end side in FIG. 7) of the platen roller 102. Since the roller 102 is of the fixed type as described above, the force applied to the driven gear when the platen roller 102 is rotationally driven may be absorbed by a shaft fastening portion of the platen roller 102. Thus, there is no problem that the platen roller 102 is lifted during the driving operation to cause positional displacement relative to the thermal head.

Although the thermal printer P2 has the advantages as described above, the thermal printer has a disadvantage that the operationability in inserting the recording paper is poor. Namely, when the recording paper is to be inserted as described above, the head-up lever 105 is operated to separate the thermal head and the platen roller 102 away from each other by several millimeters and the recording paper is inserted into the gap thus produced. However, insertion of the recording paper is often difficult when the recording paper is curled or its end is folded. Accordingly, there is a demand to improve its structure.

Therefore, a thermal printer P3 that has a structure such that a platen roller 202 may be detached as shown in FIGS. 8 and 9 has been developed.

This thermal printer P3 is composed of a frame 202 having a pair of side wall portions 201*a* and 201*b* arranged to face each other through a predetermined interval in a paper width direction, a head support member 204 for holding a thermal head 203, a platen roller attaching/detaching mechanism A' for detachably and rotatably bearing the platen roller 210 by means of the above-described pair of side wall portions 201*a* and 201*b*, a pressing mechanism B' for bringing the surface of the thermal head 203 into contact with the circumferential surface of the above-described platen roller 210 with predetermined pressing force, a gear transmission mechanism G1 for transmitting the rotational driving force of the motor M to a driven gear G2 fixed at one end (at the right end in the drawing) of the above-described platen roller 210, and so on. In the structural example shown in FIGS. 8 and 9, the pressing mechanism B' is formed integrally with the platen roller attaching/detaching mechanism A' and they operate as an integral mechanism as a whole.

As shown in FIG. 9, the platen roller attaching/detaching mechanism (pressing mechanism B') A' is provided with a swing member 300 having a U-shape as a whole and which is slightly wider than the thermal head 203 (head support member 204). The swing member 300 is provided with a pair of hook-like latch portions 301 to be engaged with both shaft ends (210*a* and 210*b*) of the platen roller so as to draw the platen roller 210 toward surface of the thermal head 203, a pair of arm portions 302 for guiding the latch portions 301 to the rear side of the head support member 204 along both sides of the thermal head 203 (head support member 204), and an elastic member support portion 303 provided at its both ends with arm portions 302 for supporting springs S10, S10 as the spring members and arranged in the width direction in the rear of the head support member 204. The swing member 300 and the head support member 204 are swingably borne through a support shaft 400 (see FIG. 10) provided between the side wall portions 201*a* and 201*b*.

Furthermore, a release lever 500 serving as an engagement release means for swinging the swing member 300 itself forwardly so as to release the engagement between the latch portions 301 and the both shaft ends 210*a* and 210*b* of the platen roller 210 is provided in the rear of the swing member 300 (see FIG. 8).

The thermal printer P3 having such a structure has such an advantage that, when giving a new supply of the recording paper or the paper clog occurred, the release lever 500 is operated to activate the platen roller attaching/detaching mechanism A' to remove the platen roller 210 from the frame 202 to thereby make it possible to perform the removal of the paper causing the paper clog, giving a new supply of the recording paper, or the like.

Nevertheless, the thermal printer P3 shown in FIGS. 8 and 9 has the above-described advantage, however, the printer suffers from such a disadvantage that the positional displacement between the thermal head 203 and the platen roller 210 can easily occur due to such arrangement that the platen roller 210 is of the detachable type.

Namely, in this thermal printer P3, various forces (F1, F2, and F3) as shown in FIG. 10 are applied to the platen roller 210 and the composite force (F4) thereof works in a direction to lift the platen roller 210. Accordingly, the positions of the thermal head 203 and the platen roller 210 are displaced from each other upon the execution of the printing operation.

More specifically, under the state where the shaft end 210 of the platen roller 210 at which the driver gear G2 is provided, is being held to the latch portion 301, the pressing force F1 to be applied via the thermal head 203 (head support member 204), the pressing force F2 to be applied via the arm portion 302 and the latch portion 301 (i.e., the force for drawing the platen roller 210 to the side of the thermal head 203) and the pressing force F3 to be applied via the driven gear G2 due to the drive of the gear transmission mechanism G1 upon the execution of the printing operation, which works in counterclockwise direction in the drawing, are applied to that shaft end 210. In particular, a part of the rotational force of F3 is converted into the force that works in a direction for moving the shaft end 210*b* apart from the latch portion 301, due to frictional force between the latch portion 301 and the circumferential surface of the shaft end 210*b*. Then, the force F4 which works in a direction for lifting the driven gear G2 side of the platen roller 210 away from the latch portion 301 is generated as the composite force of these forces F1, F2 and F3. As a result, there is a problem that the positional relationship between the thermal head 203 and the platen roller 210 is deviated from the right positional relationship.

As an approach to prevent such a lifting phenomenon of the platen roller 210, the spring pressure of the springs S10, S10 as the elastic members may be increased (for example, by using springs having higher elasticity instead or increasing the compression amount of the springs) to strengthen the pressing forces Fl and F2 to be applied to the roller 210, to thereby practically suppress the effect of the composite force F4. However, if the spring force of the springs S10, S10 is excessively increased, the frictional force between the circumferential surface of the platen roller 210 and the thermal head 203 and the frictional force between the latch portion 301 and the circumferential surface of the shaft end 210*b* are increased to increase the load on the motor M for rotating the platen roller 210. As a result, a new problem occurs such that the rpm of the platen roller 210 (delivery speed of the recording paper) is reduced, resulting in decreased printing speed.

SUMMARY OF THE INVENTION

In order to overcome the above-noted problems, an object of the present invention is to provide a thermal printer that may prevent occurrence of the lifting phenomenon of the platen roller without decreasing the printing speed.

In order to attain this object, according to the present invention, there is provided a thermal printer comprising: a frame (1) having a pair of side wall portions (2*a* and 2*b*) arranged to face each other at a predetermined interval in a paper width direction; a head support member (4) for holding a thermal head (3); a platen roller attaching/detaching mechanism (A) for detachably and rotatably bearing a platen roller (10) by the above-described pair of side wall portions; a pressing mechanism (B, coil springs S1 and S2) for bringing a surface of the above-described thermal head into contact with a circumferential surface of the above-described platen roller with predetermined pressing force; and a gear transmission mechanism (G1) for transmitting a rotational driving force of a motor (M) to a driven gear (G2) fixed at one end of the above-described platen roller, wherein a pressing force applied on a shaft end on the driven gear side of the above-described platen roller by the above-described pressing mechanism is made to be within a range of 1.3 to 3.0 times of the pressing force applied on the other shaft end.

Thus, it is possible to prevent the lifting phenomenon of the platen roller upon the execution of the printing operation and to thus prevent displacement between the platen roller and the thermal head. In addition, pressing force applied on a shaft end on the driven gear side of the platen roller by the above-described pressing mechanism is made to be within a range of 1.3 to 3.0 times of pressing force applied on the other shaft end, whereby it is possible to suppress as much as possible the increase of the load on the motor caused by the frictional force between the circumferential surface of the platen roller and the thermal head and the frictional force between the latch portion and the circumferential surface of the shaft end to thereby avoid reduction in the printing speed.

Incidentally, it is preferable that the average of the total pressure to be applied to the circumferential surface of the platen roller by the above-described pressing mechanism be in the range of 15 to 35 g/mm. Thus, it is possible to suppress the increase of the load on the motor more effectively and thus to avoid the reduction in printing speed more reliably.

Also, the above-described pressing mechanism is formed integrally with the above-described platen roller attaching/detaching mechanism, the above-described platen roller attaching/detaching mechanism is provided with a swing member having a U-shape as a whole and which is slightly wider than the above-described thermal head, the swing member is provided with a pair of latch portions to be engaged with both shaft ends of the above-described platen roller so as to draw the platen roller toward the surface of the above-described thermal head, a pair of arm portions for guiding the above-described latch portions along both sides of the above-described thermal head to the rear side of the above-described thermal head, and an elastic member support portion provided on its both sides with the above-described arm portions and arranged in a width direction in the rear of the above-described head support member for supporting elastic members, the above-described swing member and the above-described head support member are swingably supported through a support shaft provided between the above-described side wall portions, an engagement release means for moving the swing member to thereby release the engagement between the above-described latch portions and the above-described platen roller is provided in the above-described swing member, and one or two or more elastic members adapted such that pressing force applied thereby on a shaft end on the driven gear side of the above-described platen roller is 1.3 to 3.0 times larger than that applied on the other shaft end may be held between the elastic member support portion of the above-described swing member and the above-described head support member. Thus, it is possible to prevent the lifting phenomenon of the platen roller upon the execution of the printing operation to thereby prevent displacement between the platen roller and the thermal head.

Also, two or more above-described elastic members may be used and each of the above-described elastic members is arranged and positioned such that a barycenter of pressure applied on the above-described platen roller is deflected toward the shaft end on the driven gear side of the above-described platen roller by 7 to 25% whereby the pressing force applied on the shaft end on the driven gear side of the above-described platen roller may be 1.3 to 3.0 times larger than that applied on the other shaft end. Thus, simply by suitable changing the arrangement positions of the elastic members, it is possible to achieve prevention of the lifting phenomenon of the platen roller upon the execution of the printing operation.

Also, in the case where two or more above-described elastic members are used, elastic members having the same elasticity may be used. In that case, the compression amounts of the respective members are varied so that the pressing force applied on the shaft end on the driven gear side of the above-described platen roller may be 1.3 to 3.0 times larger than that applied on the other shaft end. Thus, it is possible to use elastic members of identical specifications. Therefore, it is possible to achieve prevention of the lifting phenomenon of the platen roller upon the execution of the printing operation without increasing the manufacture cost.

Also, in the case where elastic members having different elasticity are used as the above-described elastic members, each elastic member is arranged at the equal distance from the center, whereby due to the difference in the elasticity, the pressing force applied on the shaft end on the driven gear side of the above-described platen roller may be 1.3 to 3.0 times larger than that applied on the other shaft end. Thus, by suitably arranging two or more elastic members having different elasticity, it is possible to achieve prevention of the lifting phenomenon of the platen roller upon the execution of the printing operation.

Incidentally, the above-described elastic member may be made of a spring in general, rubber, synthetic resin or the like.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENT

Preferred embodiments of the present invention will now be described with reference to the accompanying drawings.

Figure 1:
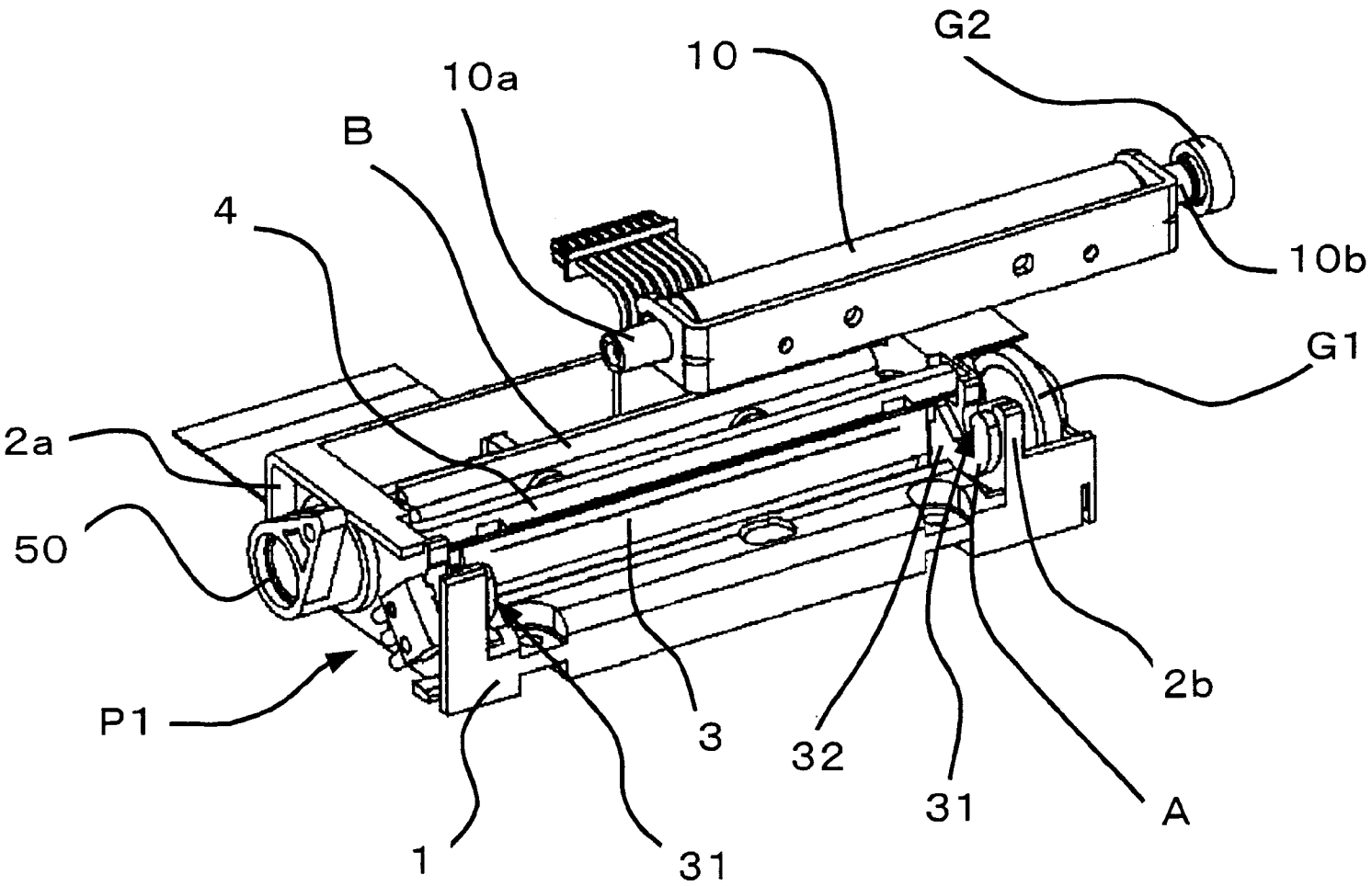
FIG. 1 is a perspective view showing a first embodiment of a thermal printer to which the present invention is applied.
Figure 2:
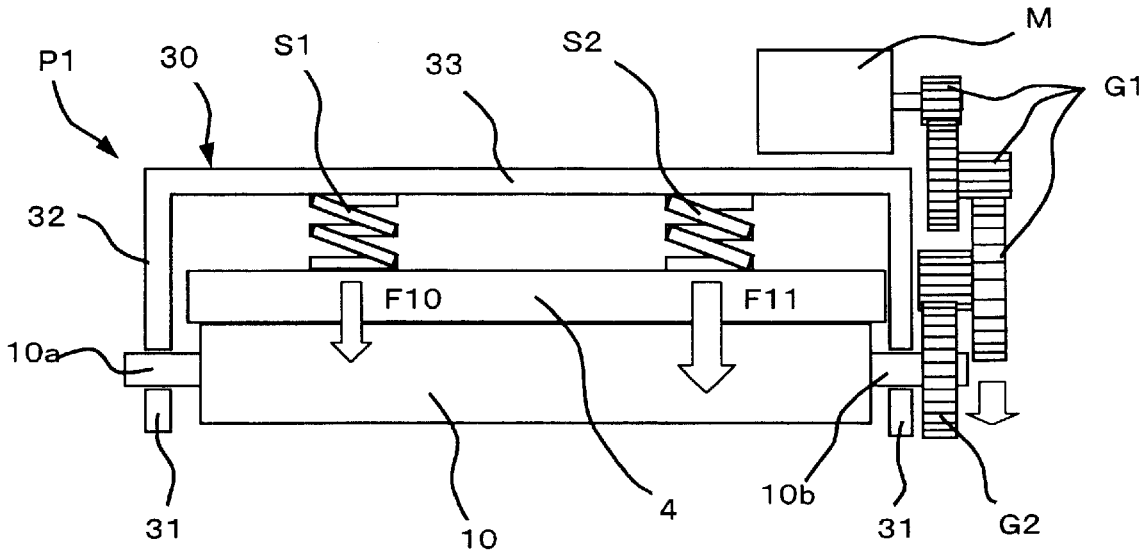
FIG. 2 is a schematic plan view showing a primary part of the thermal printer P1 according to the first embodiment.

FIG. 1 is a perspective view showing one embodiment of a thermal printer P1 according to the present invention. FIG. 2 is a schematic plan view showing a primary part of the thermal printer P1.

The thermal printer P1 is composed of a frame 1 obtained by injection molding of plastic such as polycarbonate or the like and provided with a pair of side wall portions 2*a* and 2*b* arranged to face each other through a predetermined interval in a paper width direction, a head support member 4 for holding a thermal head 3 having a number of heating elements, a platen roller attaching/detaching mechanism for detachably and rotatably bearing a platen roller 10 by the pair of side wall portions 2*a* and 2*b,* a pressing mechanism B for bringing a surface of the above-described thermal head 3 into contact with a circumferential surface of the above-described platen roller 10 with predetermined pressing force, a gear transmission mechanism G1 for transmitting a rotational driving force of a motor M to a driven gear G2 fixed to one end (right end in the drawing) of the above-described platen roller 10, and so on.

In accordance with this embodiment, the pressing mechanism B is formed integrally with the platen roller attaching/detaching mechanism A so that they operate as an integral mechanism as a whole.

As shown in FIG. 2, the platen roller attaching/detaching mechanism (pressing mechanism B) A is provided with a swing member 30 having a U-shape as a whole and which is slightly wider than the thermal head 3 (head support member 4). The swing member 30 is provided with a pair of hook-like latch portions 31 to be engaged with both shaft ends (10*a* and 10*b*) of the platen roller so as to draw the platen roller 10 toward the surface of the thermal head 3, a pair of arm portions 32 for guiding the latch portions 31 to the rear side of the head support member 4 along both sides of the thermal head 3 (head support member 4) and an elastic member support portion 33 provided at its both ends with the arm portions 32 and arranged in the width direction in the rear of the head support member 4 for supporting coil springs S1, S2 as elastic members. The swing member 30 and the head support member 4 are swingably borne through a support shaft (not shown in the drawing) provided between the side wall portions 2*a* and 2*b*.

Furthermore, a release lever 50 serving as an engagement release means for swinging the swing member 30 itself forwardly so as to releasing the engagement between the latch portions 31 and the both shaft ends 2*a* and 2*b* of the platen roller 10 is provided in the rear of the swing member 30.

In this embodiment, the coil springs S1, S2 are arranged in an equal distance position from right and left ends of the elastic member support portion 33, respectively. The elasticity coefficients E1 and E2 (E2>E1) of the respective coil springs S1 and S2 are set such that pressing force applied on a shaft end 10*b* on the driven gear G2 side of the platen roller 10 is 1.3 to 3.0 times larger than pressing force applied on the other shaft 10*a*. Also, the deformation amounts (compression amounts) of the coil springs S1, S2 are determined such that the average of the total pressure to be applied onto the circumferential surface of the platen roller 10 may fall within the range of 15 to 35 g/mm. Thus, the relationship between the pressing force F10 applied by the coil spring S1 and the pressing force F11 applied by the coil spring S2 is given as F11>F10.

Figure 6:
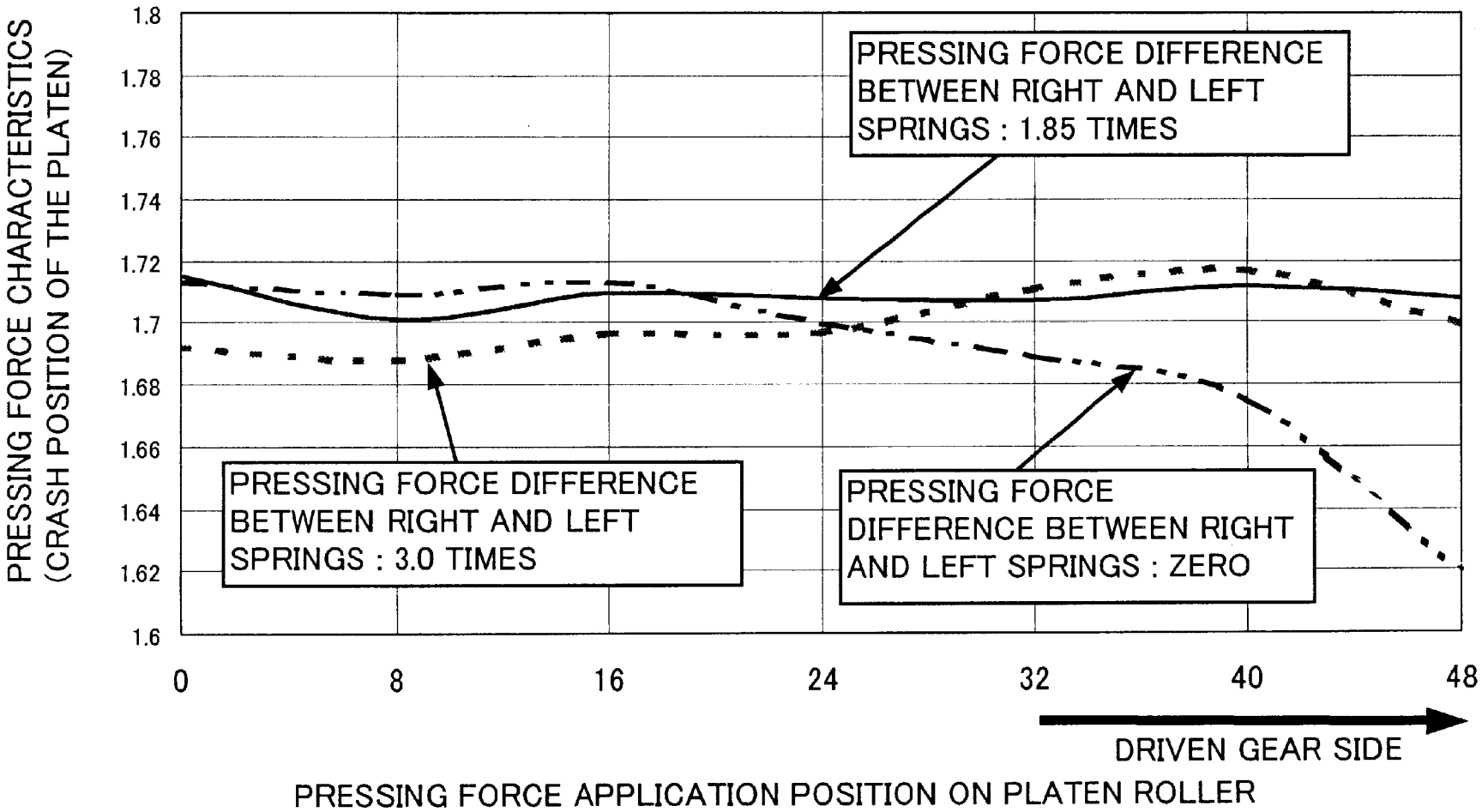
FIG. 6 is a graph showing comparison of relationships between characteristics of pressing force applied on the platen roller and positions where the pressing force is applied on the platen roller.
Figure 7:
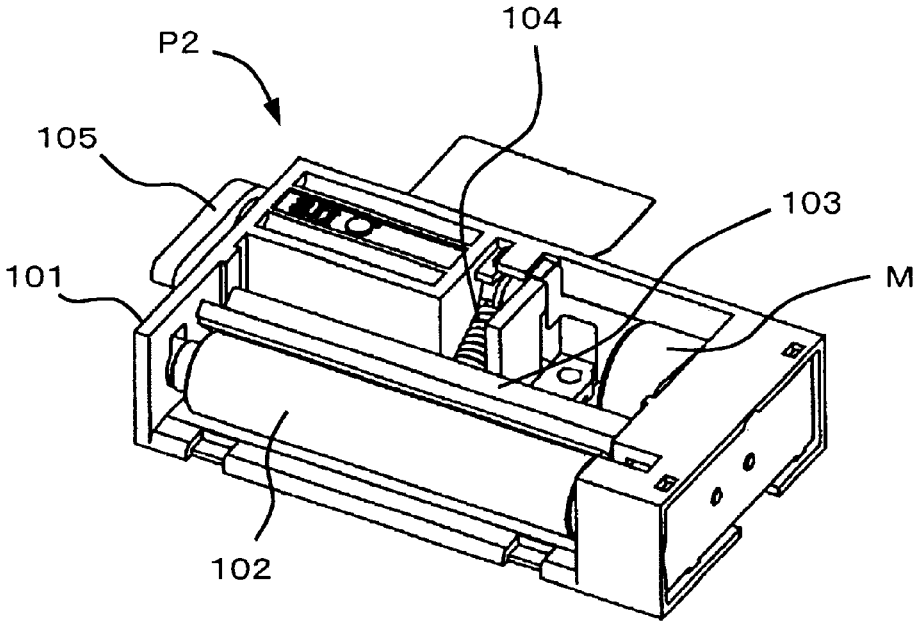
PRIOR ART Fig. 7
FIG. 7 is a perspective view showing a conventional thermal printer.

FIG. 6 is a graph showing pressure characteristics which respectively represent the case where the spring pressure difference of the spring S1, S2 is set at 0 (zero), 1.85 times, and 3.0 times, in the printer having the same structure as that of the thermal printer P1 shown in FIG. 1.

In this graph, the pressing force characteristics (crash position of the platen) are taken in the ordinate, whereas the position on the platen roller 10 where the pressing force is applied is taken in the abscissa. Incidentally, in this graph, the right side corresponds to the driven gear G2 side of the platen roller 10.

Figure 8:
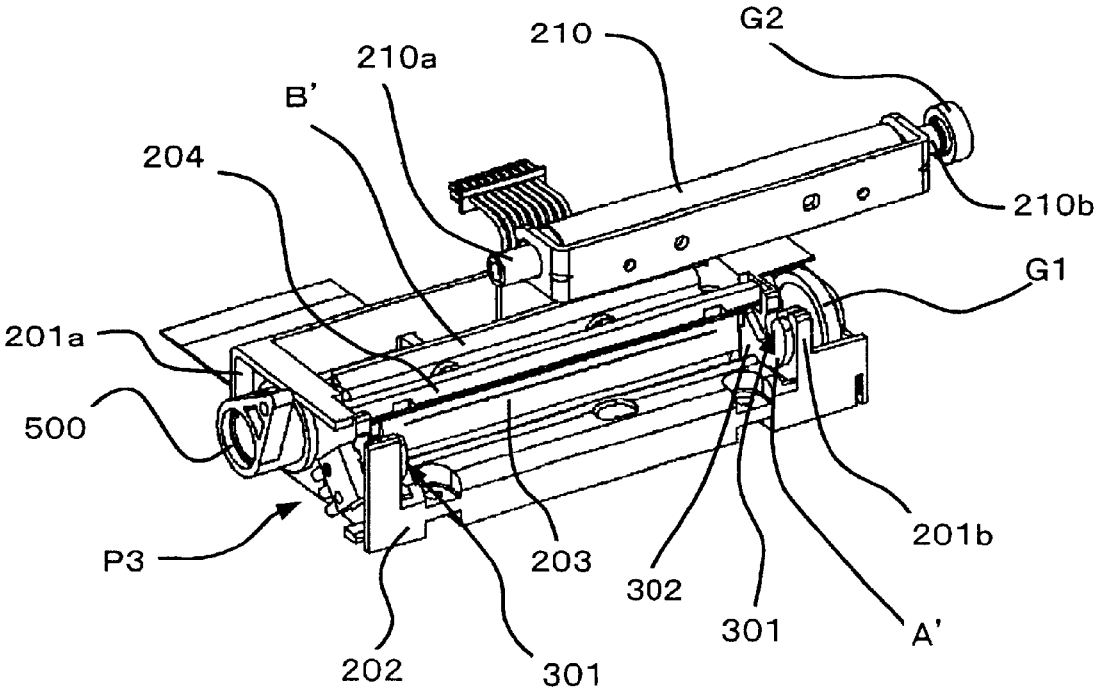
PRIOR ART Fig. 8
FIG. 8 is a partially exploded perspective view showing the conventional thermal printer.
Figure 9:
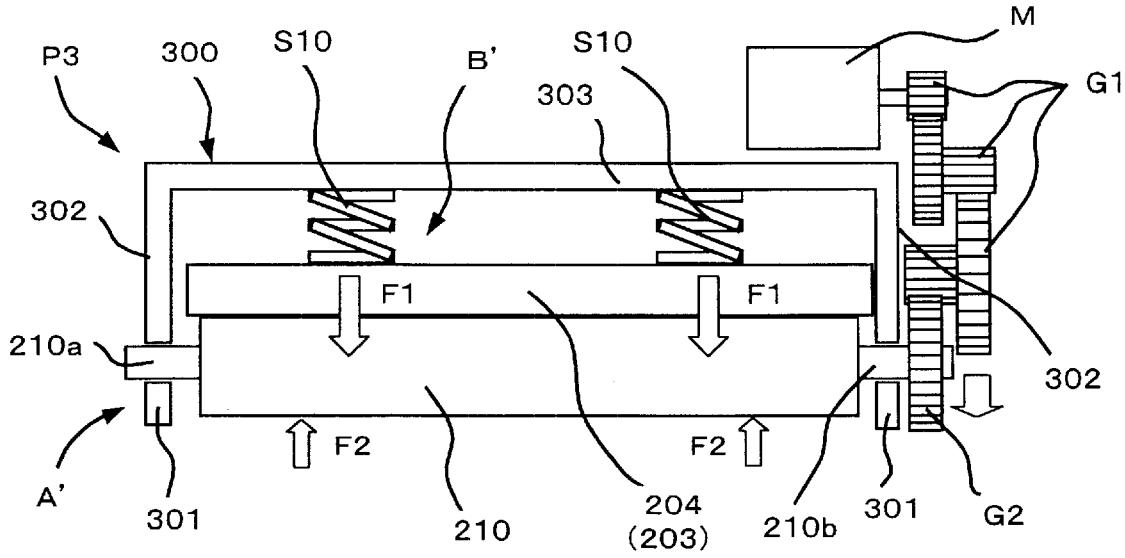
PRIOR ART Fig. 9
FIG. 9 is a schematic plan view showing the conventional thermal printer.
Figure 10:
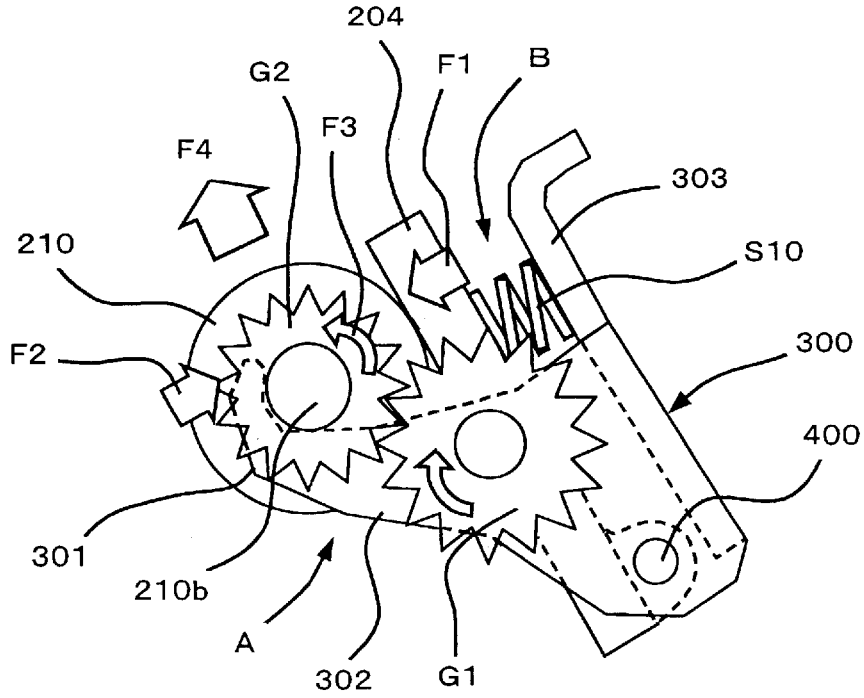
PRIOR ART Fig. 10
FIG. 10 is a schematic side elevational view showing the conventional thermal printer.

As regards the pressing force characteristics, it should be noted here that the case where the spring pressure difference between S1 and S2 is set at 0 (zero) corresponds to the same condition as that applies in the conventional thermal printer P3 shown in FIGS. 8 and 9As is apparent from this graph, the pressing force is decreased as the application position thereof becomes closer to the driven gear G2 side of the platen roller 10. This would be due to the fact that force that acts to move the shaft end 2*b* apart from the latch portion 31 is generated by the frictional force between the latch portion 31 and the circumferential surface of the shaft end 2*b* to cause the lifting phenomenon on the driven gear G2 side of the platen roller 10.

In contrast, in can be understood that, in the case where the spring pressure difference between springs S1 and S2 is set at 1.85 times or 3.0 times, the pressing force is kept substantially constant irrespective of the position on the platen roller 10 at which the pressing force is applied and the lifting phenomenon of the platen gear 10 at its driven gear G2 side is suppressed.

Accordingly, in the thermal printer P1 according to the present embodiment, it is possible to suppress the phenomenon in which the platen gear 10 is lifted at the driven gear G2 side upon the execution of the printing operation. With this, it is possible to suppress the displacement of the relative positions of the platen roller 10 and the thermal head 3 to thereby prevent degradation of printing quality. Also, since the average of the total pressure to be applied onto the circumferential surface of the platen roller 10 is set in the range of 15 to 35 g/mm, it is possible to prevent excessive increase of the load on the motor M upon the execution of the printing operation, and there is no fear that the printing speed is reduced.

Figure 3:
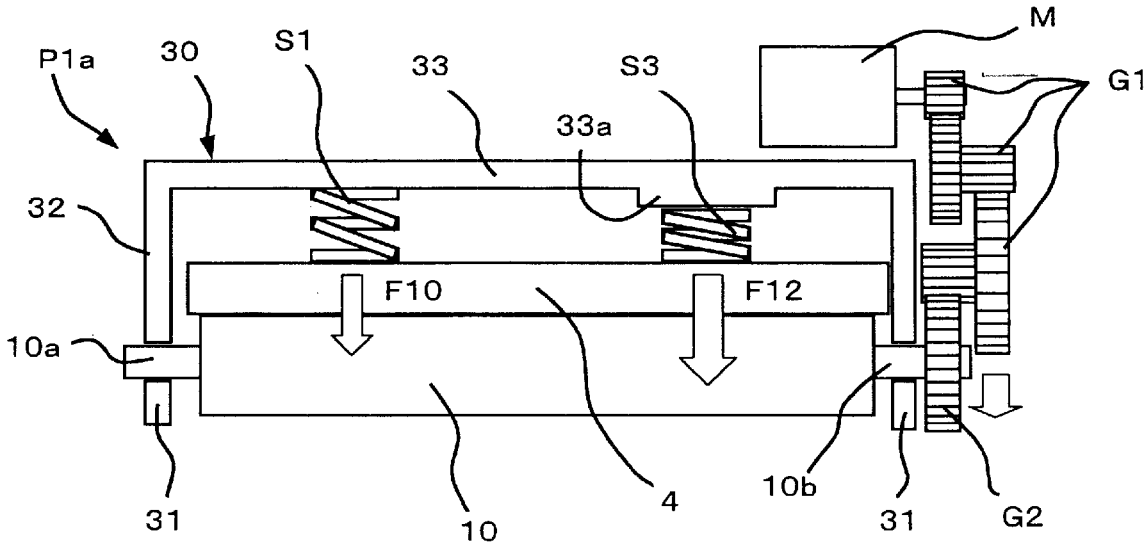
FIG. 3 is a schematic plan view showing a primary part of a thermal printer P1*a* according to a second embodiment.

A thermal printer P1*a* in accordance with a second embodiment will now be described with reference to FIG. 3. FIG. 3 is a schematic plan view showing a primary part of the thermal printer P1*a*. Incidentally, the same reference numerals are used to indicate the same components and structures as those of the thermal printer P1 in accordance with the first embodiment shown in the above FIG. 2. The detailed explanation thereof will be omitted.

The difference between the thermal printer P1*a* and the thermal printer P1 in accordance with the first embodiment resides in the manner in which the coil springs S1 and S3 as the elastic members are provided. In the thermal printer P1*a,* springs having elasticity coefficients E1 and E2 which are equal (i.e., E1=E2) are used as the coil springs S1 and S3 and the compression amount of the coil spring S3 is set to be greater than the compression amount of the coil spring S1 to thereby attain the desired effect.

More specifically, as shown in FIG. 3, a convex portion 33*a* is formed in a position where the coil spring S3 is to be arranged on the driven gear G2 side of the platen roller 10 of the elastic member support portion 33, and the coil S3 is disposed under compressed condition between this convex portion 33*a* and the back surface of the head support member 4. Incidentally, the height of the convex portion 33*a* and the elastic coefficients of the coil springs S1 and S3 are selected such that the pressing force applied on the shaft end 10*b* on the driven gear G2 side of the platen roller 10 is 1.3 to 3.0 times larger than the pressing force applied on the other shaft end 10*a* and the average of the total pressure to be applied onto the circumferential surface of the platen roller 10 is in the range of 15 to 35 g/mm. Thus, the relationship between the pressing force F10 applied by the coil spring S1 and the pressing force F12 applied by the coil spring S3 is given as F12>F10.

Also in the thermal printer P1*a* in accordance with this second embodiment, it is possible to attain the same effect as that of the above-described thermal printer P1. In addition, since the same coil springs are used in the thermal printer P1*a,* there is an advantage in that the management and provision of the parts becomes easier in comparison with the thermal printer in accordance with the first embodiment using two different springs. Incidentally, in this embodiment, although the convex portion 33*a* is formed on the side of the elastic member support portion 33 to thereby increase the compression amount of the coil spring S3, the invention is not limited thereto but it is possible to attain the same effect even in the case where the convex portion is formed on the back surface of the head support member 4.

Figure 4:
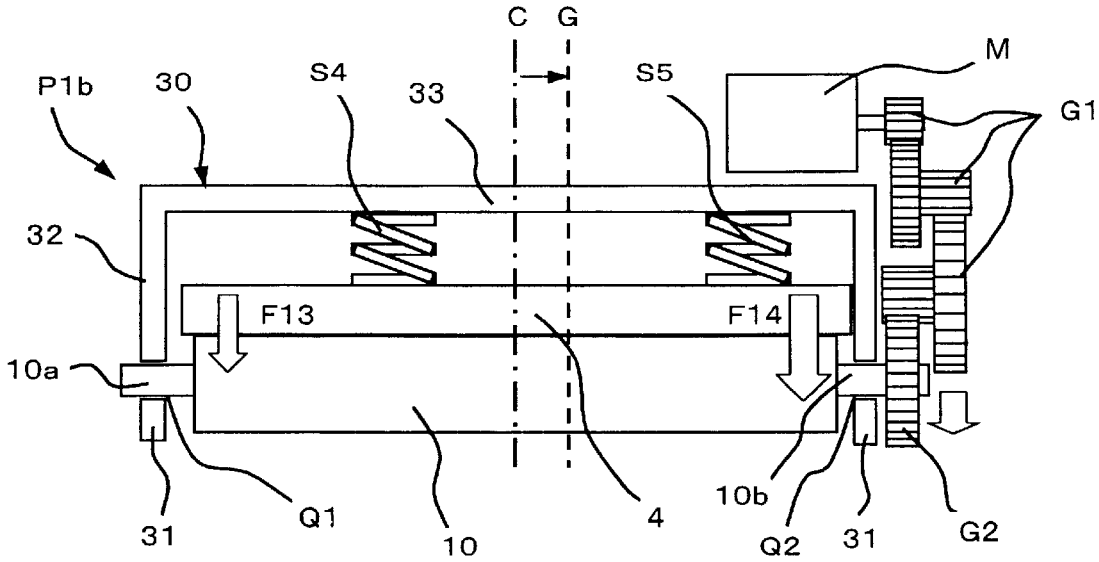
FIG. 4 is a schematic plan view showing a primary part of a thermal printer P1*b* according to a third embodiment.

A thermal printer P1*b* in accordance with a third embodiment will now be described with reference to FIG. 4. FIG. 4 is a schematic plan view showing a primary part of the thermal printer P1*b*. Incidentally, the same reference numerals are used to indicate the same components and structures as those of the thermal printers P1, P1*a* shown in the above FIGS. 2 and 3. Therefore, the detailed description thereof will be omitted.

In the thermal printer P1*b* in accordance with this embodiment, it is possible to attain the same effect as that of the above-described thermal printers P1 and P1*a* by shifting the arrangement positions of the coil springs S4 and S5 toward the driven gear G2 side of the platen roller 10. More specifically, the barycenter of the pressure applied on the platen roller 10 is deflected toward the driven gear G2 side of the platen roller 10 by 7 to 25%. Namely, in FIG. 4, when the supporting points of the platen roller 10 at its right and left ends are Q1 and Q2, respectively, and the center position thereof is taken as C, the coil springs S4 and S5 are disposed such that the barycenter G of the springs is shifted toward the driven gear G2 side of the platen roller 10 from the center of support C by 7 to 25%. With this arrangement, the relationship between the pressing force F14 applied on the shaft end 10*b* on the driven gear G2 side of the platen roller 10 and the pressing force F13 applied around the shaft end 10*a* the other end 10*a* given as F14>F13. Thus, it is possible to suppress the lifting phenomenon of the platen roller 10 at the driven gear G2 side thereof upon the execution of the printing operation. Incidentally, the coil springs S4 and S5 having the same elastic coefficient may be used or the springs having different elastic coefficients may be used. However, it is a matter of course that the arrangement positions of the coil springs S4 and S5 should be changed in accordance with their elastic coefficients.

Figure 5:
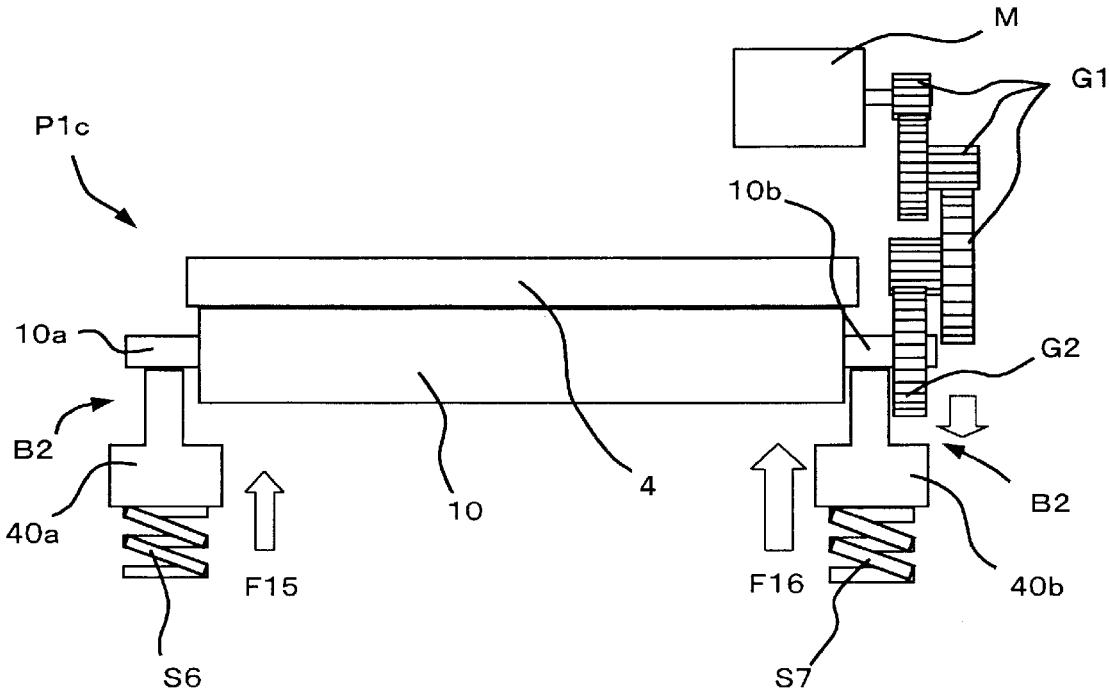
FIG. 5 is a schematic plan view showing a primary part of a thermal printer P1*c* according to a fourth embodiment.

A thermal printer P1*c* in accordance with a fourth embodiment will now be described with reference to FIG. 5. FIG. 5 is a schematic plan view showing a primary part of the thermal printer P1*c*. Incidentally, the same reference numerals are used to indicate the same components and structures as those of the thermal printers P1, P1*a,* and P1*b* shown in the above FIGS. 2, 3 and 4. Thus, the detailed description thereof will be omitted.

In the thermal printer P1*c* in accordance with this embodiment, a pressing mechanism B2 for pressing both shaft ends 10*a* and 10*b* of the platen roller 10 from the front side is provided instead of providing the elastic member support portion 33 and the like in the rear of the thermal head 3 and the head support member 4. This pressing mechanism B2 is composed of pressure members 40*a* and 40*b* for contacting with the both shaft ends 10*a* and 10*b* of the platen roller 10 and transmitting the pressure and coil springs S6 and S7 as elastic members provided on the rear side of each pressure members 40*a* and 40*b*.

As the above-described respective coil springs S6 and S7 so that the elastic coefficient E7 of S7 and the elastic coefficient E6 of S6 are given as E7>E6 and the pressing force applied on the shaft end 10*b* on the driven gear G2 side of the platen roller 10 is 1.3 to 3.0 times larger than the pressing force applied on the other shaft end 10*a* and the average of the total pressure to be applied onto the circumferential surface of the platen roller 10 is in the range of 15 to 35 g/mm.

As a result, the relationship between the pressing force F15 applied by the coil spring S6 and the pressing force F16 applied by the coil spring S7 is given as F16>F15. Thus, it is possible to suppress the lifting phenomenon of the platen gear 10 at the driven gear G2 side thereof upon the execution of the printing operation. Therefore, it is possible to suppress the displacement of the relative positions of the platen roller 10 and the thermal head 3 to prevent degradation of the printing quality. Also, since the average of the total pressure to be applied onto the circumferential surface of the platen roller 10 is set in the range of 15 to 35 g/mm, it is possible to prevent the load on the motor M from becoming excessively large upon the execution of the printing operation, and there is no fear that the printing speed is reduced. Incidentally, the invention is not limited to the case where the elastic coefficients of the coil spring S6 and S7 are set to be different from each other, since it is possible to attain the same effect by suitably changing the compression amount even when springs having the same elastic coefficient are used.

The invention made by the present inventors has been described on the basis of the embodiments. The present invention is not limited to the above-described embodiments but it is possible to variously modify or change the invention without departing from the essence thereof.

For example, in the foregoing embodiments, the case where the coil springs are used as elastic members has been described. However, the invention is not limited to this. It is possible to use springs having other configurations such as leaf springs, torsion springs or the like or to use members obtained by molding rubber or synthetic resin as the elastic members.

As described above, according to the present invention, in a thermal printer which at least comprises: a frame having a pair of side wall portions (2*a* and 2*b*) arranged to face each other at a predetermined interval in a paper width direction; a head support member for holding a thermal head; a platen roller attaching/detaching mechanism for detachably and rotatably bearing a platen roller by the pair of sidewall portions; a pressing mechanism for bringing a surface of the thermal head into contact with a circumferential surface of the platen roller; and a gear transmission mechanism for transmitting a rotational driving force of a motor to a driven gear fixed at one end of the platen roller; wherein pressing force applied on a shaft end on the driven gear side of the above-described platen roller by the above-described pressing mechanism is made to be within a range of 1.3 to 3.0 times of pressing force applied on the other shaft end. Thus, it is possible to prevent the lifting phenomenon of the platen roller upon the execution of the printing operation and thus the displacement between the platen roller and the thermal head. In addition, since the pressing force applied on a shaft end on the driven gear side of the platen roller by the pressing mechanism is made to be within a range of 1.3 to 3.0 times of the pressing force applied on the other shaft end, it is possible to suppress as much as possible the increase of the load on the motor which is caused by the frictional force between the circumferential surface of the platen roller and the thermal head and the frictional force between the latch portion and the circumferential surface of the shaft end to thereby make it possible to avoid occurrence of reduction in the printing speed.

What is claimed is:

1. A thermal printer comprising:

a frame having a pair of side wall portions arranged to face each other at a predetermined interval in a paper width direction;

a head support member for holding a thermal head;

a platen roller attaching/detaching mechanism for detachably and rotatably bearing a platen roller by the pair of side wall portions;

a pressing mechanism for bringing a surface of the thermal head into contact with a circumferential surface of the platen roller with predetermined pressing force so that pressing force applied on a shaft end on a driven gear side of the platen roller is made to be within a range of 1.3 to 3.0 times of pressing force applied on the other shaft end; and a gear transmission mechanism for transmitting a rotational driving force of a motor to the driven gear fixed at one end of the platen roller.

2. A thermal printer according to claim 1; wherein the average of the total pressure to be applied onto the circumferential surface of the platen roller by the pressing mechanism is in the range of 15 to 35 g/mm.

3. A thermal printer according to claim 1; wherein the pressing mechanism is formed integrally with the platen roller attaching/detaching mechanism, the platen roller attaching/detaching mechanism is provided with a swing member having a U-shape as a whole and is slightly wider than the thermal head, the swing member comprises a pair of hook-like latch portions to be engaged with both shaft ends of the platen roller so as to draw the platen roller toward the surface of the thermal head, a pair of arm portions for guiding the latch portions along both sides of the thermal head to the rear side of the thermal head, and an elastic member support portion provided on its both sides with the arm portions and arranged in a width direction in the rear of the head support member for supporting elastic members, the swing member and the head support member are swingably supported through a support shaft provided between the side wall portions, an engagement release means for moving the swing member to thereby release the engagement between the latch portions and the platen roller is provided in the swing member, and one or two or more elastic members adapted such that pressing force applied thereby on a shaft end on the driven gear side of the platen roller becomes 1.3 to 3.0 times larger than that applied on the other shaft end may be held between the elastic member support portion of the swing member and the head support member.

4. A thermal printer according to claim 3; wherein two or more the elastic members are used and each of the elastic members is arranged and positioned such that a barycenter of the pressing force applied on the platen roller is deflected toward the shaft end on the driven gear side of the platen roller by 7 to 25% whereby the pressing force applied on the shaft end on the driven gear side of the above-described platen roller may be 1.3 to 3.0 times larger than that applied on the other shaft end.

5. A thermal printer according to claim 3; wherein in the case where two or more said elastic members are used, elastic members having the same elasticity are used and the compression amounts of the respective elastic members are varied so that the pressing force applied on the shaft end on the driven gear side of the platen roller may be 1.3 to 3.0 times larger than that applied on the other shaft end.

6. A thermal printer according to claim 3; wherein in the case where the elastic members having different elasticity are used as the elastic members, each elastic member is arranged at the equal distance from the center, whereby due to the difference in the elasticity, the pressing force applied on the shaft end on the driven gear side of the platen roller that may be 1.3 to 3.0 times larger than that applied on the other shaft end.

7. A thermal printer according to claim 3; wherein the elastic member is made of a spring in general, rubber, synthetic resin or the like.

* * * * *